US011051600B2

(12) United States Patent
McKay

(10) Patent No.: US 11,051,600 B2
(45) Date of Patent: Jul. 6, 2021

(54) HAIR WRAP TOWEL ARTICLE

(71) Applicant: William Douglas McKay, Phoenix, AZ (US)

(72) Inventor: William Douglas McKay, Phoenix, AZ (US)

(73) Assignee: MYSA TOWEL LLC, Phoenix, AZ (US)

( * ) Notice: Subject to any disclaimer, the term of this patent is extended or adjusted under 35 U.S.C. 154(b) by 0 days.

(21) Appl. No.: 16/166,487

(22) Filed: Oct. 22, 2018

(65) Prior Publication Data

US 2020/0121052 A1 Apr. 23, 2020

(51) Int. Cl.
*A42B 1/041* (2021.01)
*A45D 20/00* (2006.01)

(52) U.S. Cl.
CPC ..... *A45D 20/00* (2013.01); *A42B 1/041* (2013.01)

(58) Field of Classification Search
CPC .. A42B 1/04; A42B 1/041; A42B 1/12; A42B 1/22; A47K 10/02; A45D 44/00
See application file for complete search history.

(56) References Cited

U.S. PATENT DOCUMENTS 1,920,387 A 8/1933 Harper
5,365,613 A * 11/1994 Henegan ..... A42B 1/041 2/171
D381,790 S 8/1997 Harris et al.
D412,234 S 7/1999 Cox
D414,915 S 10/1999 Anderson
6,427,251 B1 * 8/2002 Leach ..... A42B 1/041 2/174
D486,622 S 2/2004 Matsuda
D498,345 S * 11/2004 Maya ..... D2/880
7,412,729 B1 8/2008 McGovern
D632,058 S 2/2011 Pritchett
D641,140 S 7/2011 Clarke
9,138,025 B1 9/2015 Lunsford
D753,373 S 4/2016 Esmer
9,907,381 B2 3/2018 Tussey
10,021,930 B2 7/2018 De Jesu
(Continued)

OTHER PUBLICATIONS https://aquis.com/collections/your-dream-hair-awaits/products/rapid-dry-hair-turban.
https://aquis.com/collections/your-dream-hair-awaits/products/rapid-dry-waffle-hair-turban.
https://www.turbietwist.com/.

*Primary Examiner* — Tajash D Patel
(74) *Attorney, Agent, or Firm* — Dinsmore & Shohl LLP

(57) ABSTRACT

A hair wrap article comprises a plurality of swaths of cloth dimensionally cut and stitched together to form the article comprising a volume, wherein an article first end comprises a first volume opening greater than a second volume opening at an article second end. The article comprises a securing tab at an exterior portion of the article first end or a plurality of through slits, either one to receive and secure the article second end. The article may comprise the following: the securing tab comprising an isosceles trapezoid geometric configuration; a secondary securing tab proximate the securing tab to alternately operate to receive and secure the article second end; a semi-rigid ribbing stitched into the stitched together portion of the article; and a portion of the second volume opening may be stitched together to close the second volume opening to create an article second end internal volume.

25 Claims, 5 Drawing Sheets

(56) References Cited

U.S. PATENT DOCUMENTS

| | | | | |
|---|---|---|---|---|
| D836,302 | S | 12/2018 | Alba | |
| 2007/0056079 | A1 | 3/2007 | Didier | |
| 2008/0229479 | A1* | 9/2008 | Butterly | A45D 19/18 2/174 |
| 2009/0151048 | A1 | 6/2009 | Laury | |
| 2012/0079643 | A1 | 4/2012 | Clarke | |
| 2012/0240309 | A1* | 9/2012 | Albright | A42B 1/041 2/181 |
| 2015/0335087 | A1 | 11/2015 | Martin et al. | |
| 2017/0042268 | A1 | 2/2017 | Lessard | |
| 2017/0105504 | A1 | 4/2017 | Oishi et al. | |
| 2018/0235411 | A1* | 8/2018 | Guerra-Sievers | A42B 1/00 |

* cited by examiner

HAIR WRAP TOWEL ARTICLE

TECHNICAL FIELD

This disclosure relates generally to bathroom articles, and more particularly to a hair wrap towel article to secure and encase the hair of a user, and most often a user's wet hair condition.

CROSS-REFERENCE TO RELATED APPLICATIONS

None

BACKGROUND

Bathing habits of individuals vary greatly, and a preference among many users is to procure a towel to wrap about their head after bathing to facilitate; securing their wet hair, securing a large volume of hair, promote drying of the hair by the towel; for comfort, etc. Often, users rely upon a standard sized and dimensioned bath, body towel to use as a hair wrap; but such towels generally comprise dimensions that are larger than what would be preferred, are inappropriately dimensioned, and are cumbersome to use as a hair wrap. In the alternative, hand towels and other generally industry standard towels are of a limited size that they are insufficient for such use. Moreover, the hospitality industry, particularly high-end hotels, resorts, spas, salons, cruise ships, which seek to offer premium services and goods to their clientele, as of yet, do not provide any such specifically directed hair wrap towels.

What is needed, and disclosed herein, is a hair wrap towel article that is configured specifically for such hair wrap use. It comprises sufficient dimensions and securing mechanisms for more convenient use as a hair wrap towel, comprises elements that provides to more securely wrap the hair of the user, and is configured to provide for a more aesthetically pleasing look when used by the user as a hair wrap towel as well as in the folded position awaiting use.

SUMMARY

In general, a preferred embodiment of a hair wrap towel article comprises a plurality of swaths of cloth dimensionally cut and stitched together to form the hair wrap towel article to comprise a volume, wherein an article first end comprises a first volume opening greater than a second volume opening at an article second end. The hair wrap towel article, in one embodiment also comprises a securing tab at an exterior portion of the article first end to receive and secure the article second end. In a secondary embodiment, the hair wrap towel article comprises a plurality of through slits at the article first end to similarly receive and secure the article second end.

In an embodiment, the plurality of swaths of cloth comprise two swaths of cloth that are substantially identical in dimensional size and stitched together along its edges to comprise the volume. The securing tab may comprise an isosceles trapezoid geometric configuration; and the securing tab may further comprise a secondary securing tab proximate the securing tab to alternately operate to receive and secure the article second end. The article may comprise an article volume opening that tapers at a linear rate from the first volume opening to the second volume opening. The article may also comprise a semi-rigid ribbing stitched into the stitched together portion of the article; and some embodiments may comprise a portion of the second volume opening to be stitched together to close the second volume opening to create an article second end internal volume.

Exemplary embodiments may further comprise other elements and such elements may be disclosed further in the detailed description below.

A more complete understanding of a hair wrap towel article may be derived by referring to the detailed description and claims when considered in connection with the above illustrative FIGS. In the FIGS., the same reference numbers may refer to the same respective elements and/or steps throughout the FIGS.

Elements and/or steps in the FIGS. are illustrated for simplicity and clarity and are not necessarily rendered according to any particular sequence. For example, steps that may be performed concurrently or in a different order are illustrated in the FIGS. to help to improve an understanding of exemplary embodiments of the hair wrap towel article.

For simplicity and clarity of illustration, the FIGS. illustrate the general manner of construction, however, descriptions and details of well-known features and techniques can be omitted to avoid unnecessarily obscuring a hair wrap towel article and/or any methods of manufacture. Additionally, elements in the FIGS. are not necessarily drawn to scale. For example, any illustrative or perceived dimensions of elements in the FIGS. can and may be exaggerated relative to other elements to help improve an understanding of embodiments of the hair wrap towel article and/or its methods of manufacture.

DETAILED DESCRIPTION

Embodiments described herein may be described in terms of article elemental configuration and functional purpose, functional block components, and various processing steps. Any functional blocks may be realized by any number of hardware components configured to perform the specified functions and to achieve various results. For example, a hair wrap towel article may employ various elemental components, e.g., cloth swaths, straps, mesh fabric, stretchable material, and the like. Embodiments of a hair wrap towel article may comprise various securing mechanisms, such as, secure stitching, tabs, zippers, hook and loop elements, hinges, pins, clips, fittings, loops, buttons, cords, straps, magnets, sonic welds, heat seals, and the like, which may carry out a variety of functions. In addition, a hair wrap towel article may be practiced in conjunction with any number of settings, such as for general pre/post bathing use, while lounging, during spa or salon treatments, and other commensurate settings known by those skilled in the art.

Also, any articles and/or methods described are merely exemplary embodiments and/or applications for a hair wrap towel article; and the hair wrap towel article may employ any number of conventional techniques for manufacturing, distributing, marketing, packaging, shipping, selling, and the like.

Figure 1:
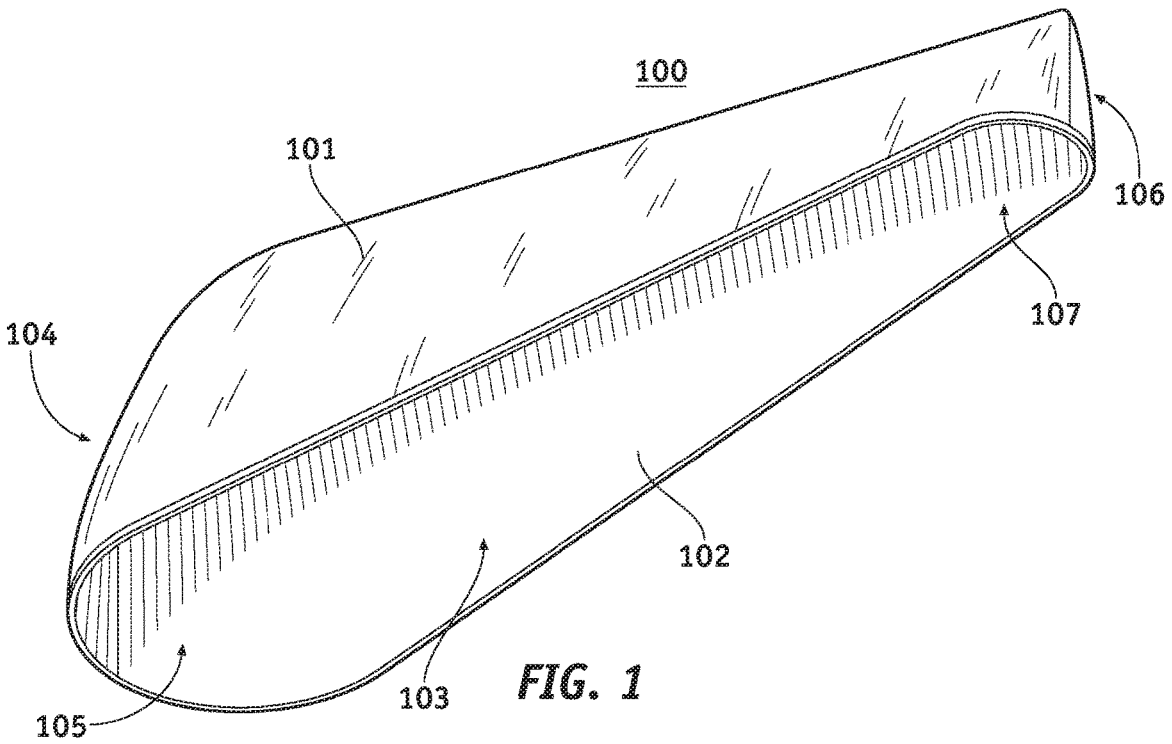
FIG. 1 depicts a perspective view of a representative embodiment of a hair wrap towel article.
Figure 2:
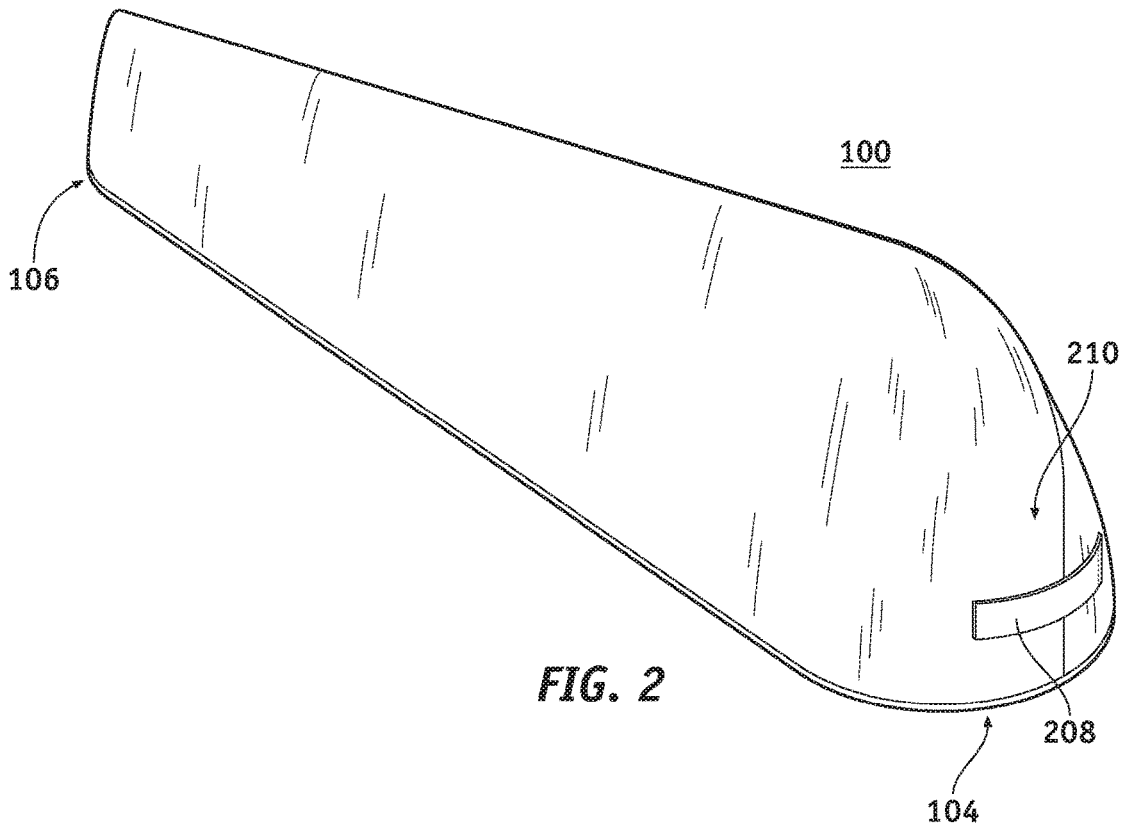
FIG. 2 depicts a second perspective view of the representative embodiment of the hair wrap towel article.

Various exemplary embodiments may be applied to any article and/or method to produce and otherwise provide for a hair wrap towel article. Turning now to the FIGS., FIG. 1 depicts a preferred embodiment of a hair wrap towel article 100 comprising a plurality of swaths of cloth 101 and 102 dimensionally cut and stitched together to form article 100 comprising a volume 103, wherein an article first end 104 comprises a first volume opening 105 greater than a second volume opening 107 at an article second end 106. Article 100 further comprises a securing tab 208 (FIG. 2) at an exterior portion 210 of article first end 104 to receive and secure article second end 106. With momentary reference to FIG. 5, FIG. 5 shows how second end 106 of article 100 is wrapped, folded, and secured by securing tab 208.

Continuing now with plurality of swaths of cloth 101 and 102 as shown by FIG. 1, plurality of swaths of cloth 101 and 102, in a preferred embodiment, comprises two swaths of cloth that are substantially identical in dimensional size and stitched together along its edges to provide for volume 103. Those skilled in the art, though, will appreciate that any number of swaths of cloth may be stitched together to provide for volume 103. Moreover, those skilled in the art will appreciate and understand that swaths of cloth may comprise any single or combination of materials to provide for article 100. For example, swaths of cloth may comprise various linens, cotton-based materials, silk-based materials, polyester based materials, and any other natural or synthetic type material.

Figure 3:
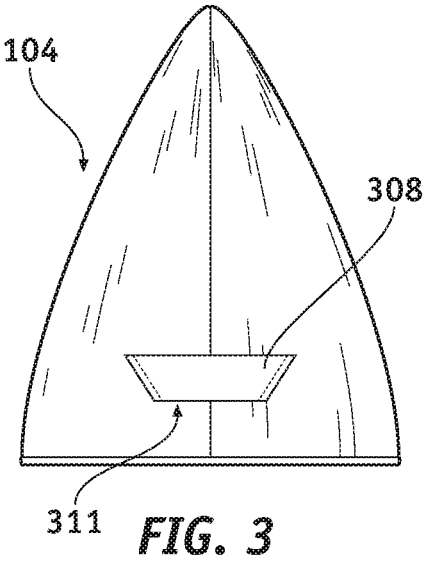
FIG. 3 depicts a first end of the representative embodiment of the hair wrap towel article showing a securing tab.
Figure 4:
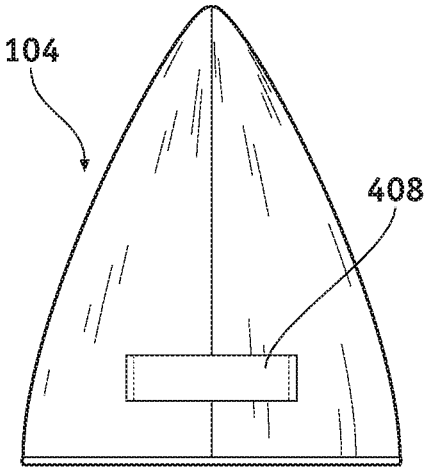
FIG. 4 depicts the first end of the representative embodiment of the hair wrap towel article showing another securing tab.
Figure 5:
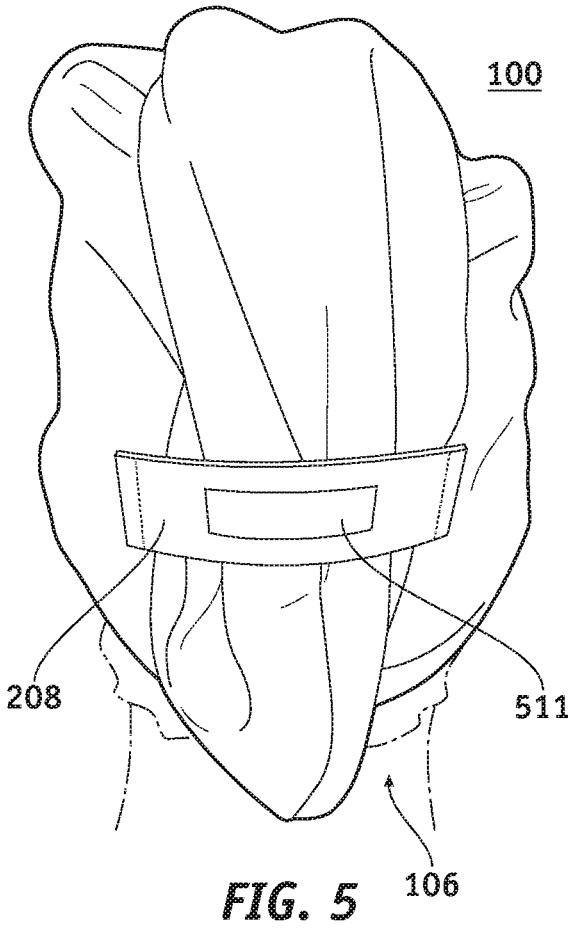
FIG. 5 depicts the first end of the representative embodiment of the hair wrap towel article showing still another securing tab configuration.
Figure 6:
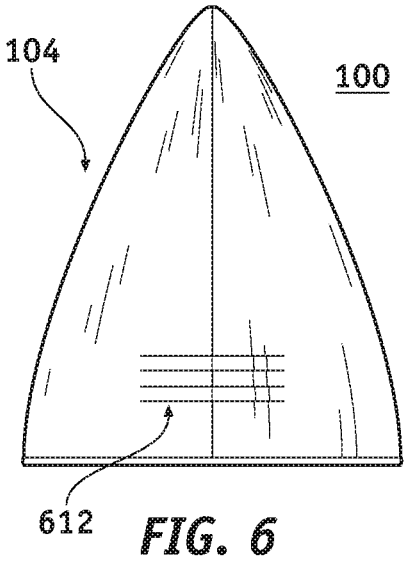
FIG. 6 depicts the first end of the representative embodiment of the hair wrap towel article showing securing slits.

Turning now to FIGS. 3-5, article 100 comprises securing tabs that may comprise a variety of geometric shapes and configurations. For example, securing tab 308 as shown in FIG. 3 comprises, in a preferred embodiment, an isosceles trapezoid geometric configuration, such that when article second end 106 is placed through securing tab 308, a narrow portion 311 of securing tab 308 effectively cinches and secures article second end 106. FIG. 4 shows securing tab 408 comprising an alternate rectangular configuration, and those skilled in the art will appreciate that securing tabs may comprise any number of geometric configurations whether regular or irregular in geometric configuration. In an alternate embodiment, FIG. 5 shows securing tab 208 comprising a secondary securing tab 511 proximate securing tab 208, wherein secondary securing tab 511 may alternately operate to receive and secure article second end 106; and similar to securing tab 208, secondary securing tab 511 may likewise comprise various geometric shapes, whether regular or irregular, and various configurations. In an alternate securing embodiment, and with reference to FIG. 6, article 100 may alternately comprise a slit or plurality of slits, such as a plurality of through slits 612 at article first end 104, to also receive and secure article second end 106.

Figure 7:
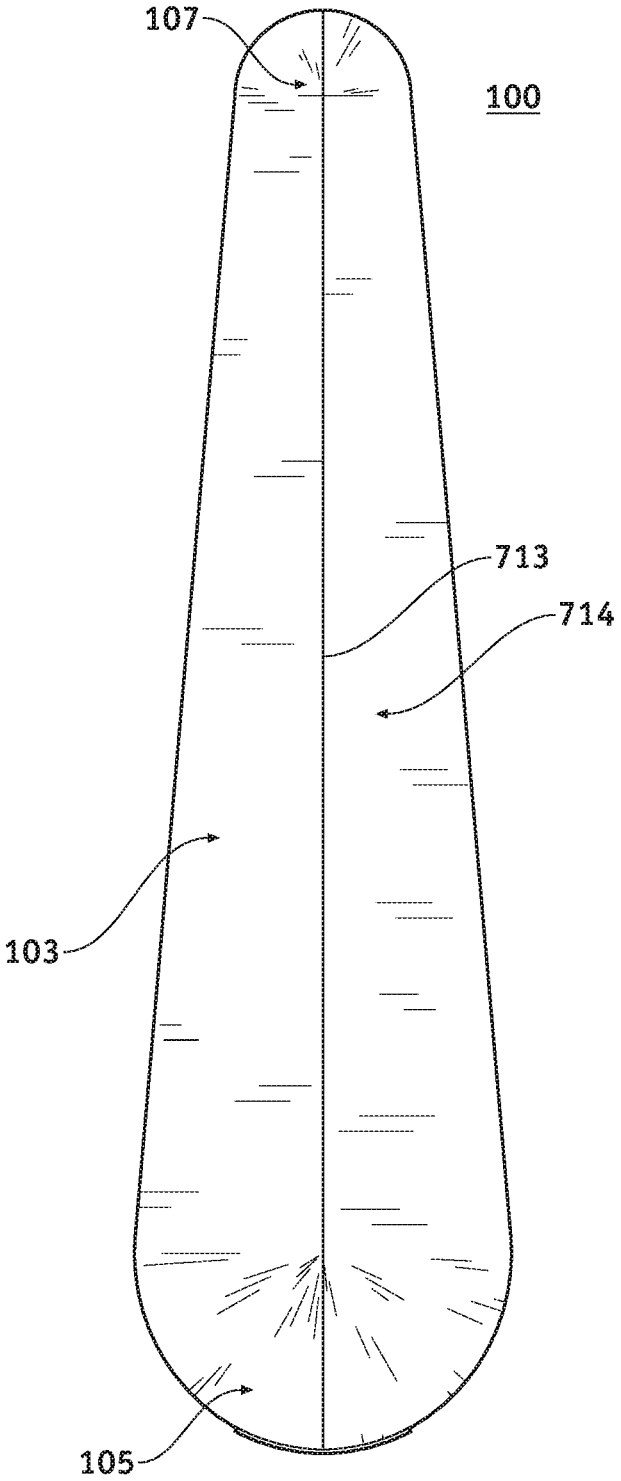
FIG. 7 depicts an underside of the representative embodiment of the hair wrap towel article.
Figure 8:
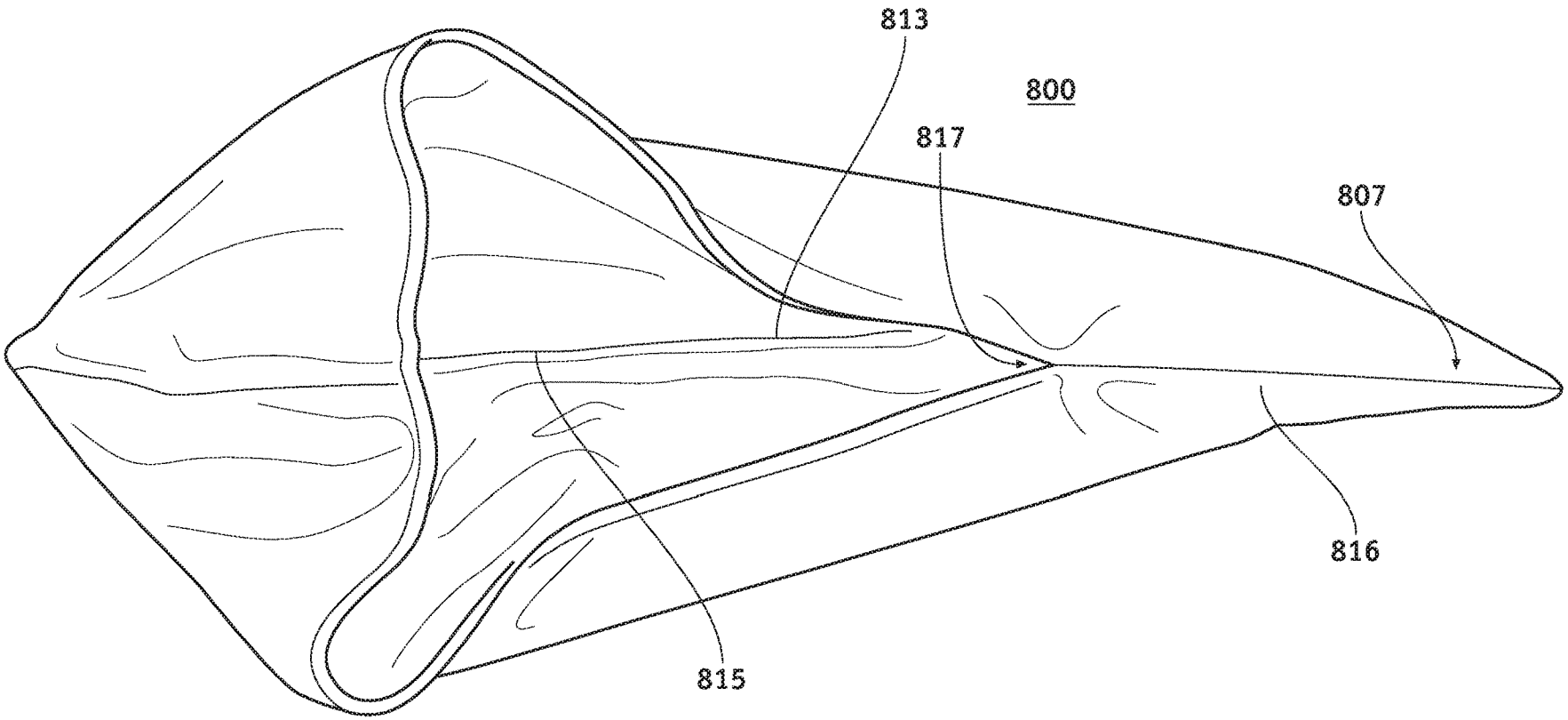
FIG. 8 depicts a perspective view of another representative embodiment of a hair wrap towel article.

Turning now to FIG. 7, in a preferred embodiment, article 100 comprises article volume opening 103 that tapers at a linear rate from first volume opening 105 to second volume opening 107; and in a continued preferred embodiment comprises stitching 713 that extends down a center line 714 of article 100. However other embodiments may comprise article 100 comprising volume opening 103 that may taper at an irregular rate from first volume opening 105 to second volume opening 107.

It will be appreciated by those skilled in the art that any of the various stitching discussed herein may comprise any type or pattern of stitching generally known in the art or used to secure pieces of fabric together. Moreover, custom stitching may be employed to secure the swaths of cloth together. In alternate embodiments, those skilled in the art will also appreciate that rather than stitching the swaths of cloth together, the swaths of cloth may be secured by any of a variety of hook and loop mechanisms, tabs, pins, snaps, clips, buttons, loops, zippers, sonic welds, heat seals, etc.

Among some embodiments, article 800 may further comprise a semi-rigid ribbing 815 stitched into the stitched together portion 813 of article 800 to provide for additional stability to article 800. Other embodiments may comprise a portion of second volume opening 807 that is stitched together at 816 to close second volume opening 807 to create an article second end internal volume 817.

Figure 9:
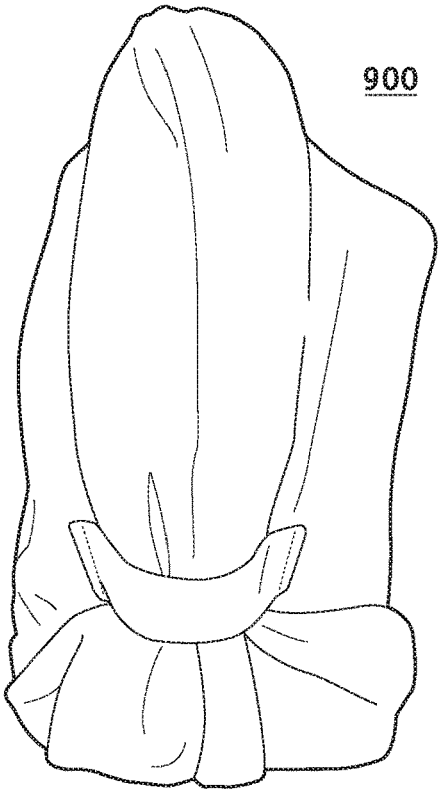
FIG. 9 depicts the representative embodiment of the towel wrap article shown in a folded, representatively displayed configuration.

With reference to FIG. 9, FIG. 9 shows how article 900 may be decoratively folded for an aesthetically pleasing display that will be appreciated by those skilled in the art for placement at high end facilities, such as spas, resort, hotels, salons, saunas, cruise ships, and the like, as well as merely for general folded storage. In the decoratively folded condition, article 900 may be laid flat on a surface for display or alternately positioned in a stand-alone, upright position.

Figure 10:
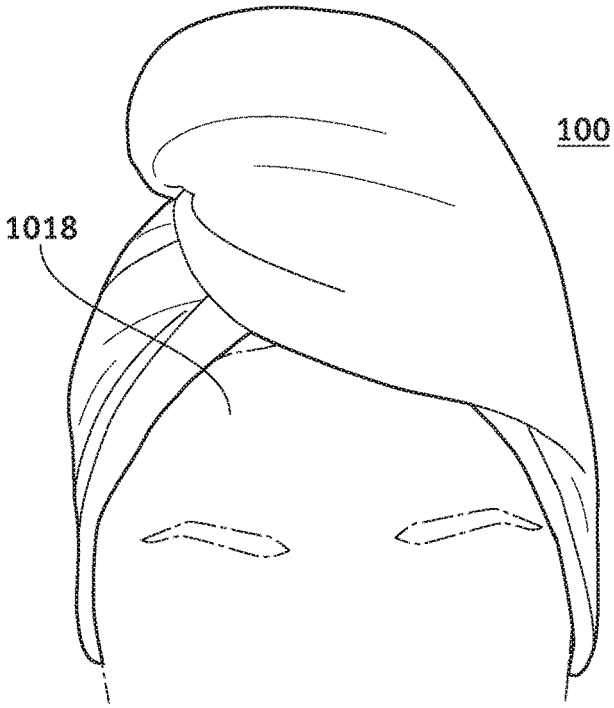
FIG. 10 depicts the representative embodiment of the towel wrap article shown in an intended use position by a user.

With reference to FIG. 10, FIG. 10 shows how an article, such as article 100, 800 or 900 and any others may be positioned by a user 1018 to function as a hair wrap towel article. In a preferred use, a user 1018 positions a top portion of their head, comprising their hair to wrap, within first volume opening 105 to encase their hair; the remainder of the article, such as articles 100, 800, 900 and others, is subsequently twisted to tighten the article to the users head, and then the article's second end, such as second end 106, secures within securing tabs, such as securing tabs 208, 308, 408, 511, or within slits 612, thus completing the preferred use of the hair wrap towel article as disclosed. It will be appreciated by those skilled in the art that while the article's second end, such as second end 106, may be secured by any of securing tabs 208, 308, 408, 511, or within slits 612, alternate securing mechanisms may be employed to secure the article's second end. Alternate mechanisms may comprise any of a variety of hook and loop mechanisms, tabs, snaps, clips, pins, buttons, and any other type of securing mechanisms now known in the art or developed in the future.

Among the various embodiments, a method for manufacturing a hair wrap towel article comprises: cutting a plurality of swaths of cloth dimensionally; stitching the plurality of swaths of cloth together to form the article to comprise a volume, wherein an article first end comprises a first volume opening greater than a second volume opening at an article second end; and at least one of; affixing a securing tab at an exterior portion of the article first end to receive and secure the article second end, and cutting at least a pair of through slits at the article first to receive and secure the article second end.

In a preferred embodiment, the plurality of swaths of cloth comprise two swaths of cloth that are substantially identical in dimensional size and stitched together along its edges to comprise the volume. Affixing the securing tab comprises affixing the securing tab comprising an isosceles trapezoid geometric configuration. Alternately, the securing tab further comprises a secondary securing tab affixed proximate the securing tab to alternately operate to receive and secure the article second end.

Among various embodiments, an article volume opening tapers at a linear rate from the first volume opening to the second volume opening, and may further comprising stitching a semi-rigid ribbing into the stitched together portion of the article. One embodiment comprises a portion of the second volume opening that is stitched together to close the second volume opening to create an article second end internal volume.

In the foregoing specification, hair wrap towel articles have been described with reference to various representative embodiments. Various modifications and changes may be made, however, without departing from the scope of the hair wrap towel article as set forth in the claims. The detailed description and FIGS. are illustrative, rather than restrictive, and modifications are intended to be included within the scope of the various representative embodiments. Accordingly, the scope of the representative embodiments should be determined by the claims and their legal equivalents, rather than by merely the embodiments described.

For example, the steps recited in any method or process claims may be executed in any order and are not necessarily limited to the specific order presented in the claims. Additionally, the components and/or elements recited in any article, system, apparatus and/or device claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required, or essential features or components of any or all the claims.

As used herein, the terms "comprise", "comprises", "comprising", "having", "including", "includes" "is" or any variation thereof, are intended to reference a non-exclusive inclusion, such that a process, method, article, system, device, composition or apparatus that comprises a list of elements does not necessarily include only those elements recited, but may also include other elements not expressly listed or inherent to such process, method, article, system, device, composition or apparatus. Other combinations and/or modifications of the above-described structures, arrangements, applications, proportions, elements, materials or components used in the practice of hair wrap towel articles, in addition to those not specifically recited, may be varied or otherwise particularly adapted to specific environments, manufacturing specifications, design parameters or other operating requirements without departing from the general principles of the same.

As used herein, the terms "first," "second," "third," "fourth," and the like in the detailed description and in the claims, if any, are used for distinguishing between similar elements and may not necessarily be for describing a particular sequential or chronological order. It is to be understood that the terms so used are interchangeable under appropriate circumstances such that the representative embodiments of hair wrap towel articles and their methods of manufacture described herein are, for example, capable of operation in sequences other than those illustrated or otherwise described herein.

The terms "left," "right," "top," "bottom," "front," "back," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of hair wrap towel articles and their methods of manufacture described herein are, for example, capable of operation in other orientations than those illustrated or otherwise described herein. The term "coupled," as used herein, is defined as directly or indirectly connected in a physical, mechanical, electrical, magnetic, or other manner.

What is claimed is:

1. A hair wrap towel article, comprising:

a plurality of swaths of cloth dimensionally cut and stitched together along an edge of each swath of cloth to form a substantially inclined hair wrap towel comprising an underside comprising a volume with a first volume at a first end of the volume and gradually decreasing to a second volume at a second end of the volume, wherein the first volume is greater than the second volume, and a generally planar securing tab coupled at an exterior portion of the article first end to receive and secure the article second end, the generally planar securing tab extending over a centerline of the hair wrap towel with ends of the tab being attached at opposed sides of the hair towel wrap.

2. The article of claim 1, wherein the plurality of swaths of cloth comprise two swaths of cloth that are substantially identical in dimensional size and stitched together along the edge of each swath of cloth to form the centerline and to comprise the volume.

3. The article of claim 1, wherein the generally planar securing tab comprises an isosceles trapezoid geometric configuration.

4. The article of claim 1, wherein volume tapers at a linear rate from the first volume to the second volume.

5. The article of claim 3, wherein the generally planar securing tab comprises a secondary securing tab proximate the securing tab to alternately operate to receive and secure the article second end.

6. The article of claim 2, further comprising a semi-rigid ribbing stitched into the centerline of the article.

7. The article of claim 1, wherein a portion of the second end is stitched together to create an article second end internal volume.

8. A method for manufacturing a hair wrap towel article, comprising:

cutting a plurality of swaths of cloth dimensionally;

stitching the plurality of swaths of cloth together along an edge of each swath of cloth to form a substantially inclined hair wrap towel comprising an underside comprising a volume with a first volume at a first end of the volume and gradually decreasing to a second volume at a second end of the volume, wherein, the first volume is greater than the second volume, and affixing a generally planar securing tab at an exterior portion of the article first end to receive and secure the article second end, the securing tab extending over a centerline of the hair wrap towel, the affixing comprising attaching ends of the tab at opposed sides of the hair towel wrap.

9. The method of claim 8, wherein the plurality of swaths of cloth comprise two swaths of cloth that are substantially identical in dimensional size and stitched together along the edge of each swath of cloth to form the centerline and to comprise the volume.

10. The method of claim 8, wherein affixing the generally planar securing tab comprises affixing the securing tab having an isosceles trapezoid geometric configuration.

11. The method of claim 9, wherein the volume tapers at a linear rate from the first volume to the second volume.

12. The method of claim 9, wherein the generally planar securing tab further comprises a secondary securing tab affixed proximate the securing tab to alternately operate to receive and secure the article second end.

13. The method of claim 9, further comprising stitching a semi-rigid ribbing into the centerline of the article.

14. The article of claim 9, wherein a portion of the second end is stitched together to create an article second end internal volume.

15. A hair wrap towel article, comprising:

a plurality of swaths of cloth dimensionally cut and stitched together along an edge of each swath of cloth to form a substantially inclined hair wrap towel comprising an underside comprising a volume with a first volume at a first end of the volume and gradually decreasing to a second volume at a second end of the volume, wherein the first volume is greater than the second volume, a securing tab coupled at an exterior portion of the article first end to receive and secure the article second end; and a secondary securing tab proximate the securing tab to alternately operate to receive and secure the article second end.

16. The article of claim 15, wherein the plurality of swaths of cloth comprise two swaths of cloth that are substantially identical in dimensional size and stitched together along the edge of each swath of cloth to form the centerline and to comprise the volume.

17. The article of claim 15, wherein the securing tab comprises an isosceles trapezoid geometric configuration.

18. The article of claim 15, wherein volume tapers at a linear rate from the first volume to the second volume.

19. The article of claim 15, further comprising a semi-rigid ribbing stitched into a centerline of the article.

20. The article of claim 15, wherein a portion of the second end is stitched together to create an article second end internal volume.

21. A hair wrap towel article, comprising:

a plurality of swaths of cloth dimensionally cut and stitched together along an edge of each swath of cloth to form a substantially inclined hair wrap towel comprising an underside comprising a volume with a first volume at a first end of the volume and gradually decreasing to a second volume at a second end of the volume, wherein the first volume is greater than the second volume, a semi-rigid ribbing stitched into a centerline of the article; and a securing tab coupled at an exterior portion of the article first end to receive and secure the article second end.

22. The article of claim 21, wherein the plurality of swaths of cloth comprise two swaths of cloth that are substantially identical in dimensional size and stitched together along the edge of each swath of cloth to form the centerline and to comprise the volume.

23. The article of claim 21, wherein the securing tab comprises an isosceles trapezoid geometric configuration.

24. The article of claim 21, wherein volume tapers at a linear rate from the first volume to the second volume.

25. The article of claim 21, wherein a portion of the second end is stitched together to create an article second end internal volume.

* * * * *